United States Patent [19]

Walters

[11] Patent Number: 4,867,191

[45] Date of Patent: Sep. 19, 1989

[54] SOLAR ACTIVATED GAS LIGHT CONTROL MODULE

[75] Inventor: Jon S. Walters, St. Louis, Mo.

[73] Assignee: American General Products, Inc., St. Louis, Mo.

[21] Appl. No.: 248,138

[22] Filed: Sep. 23, 1988

[51] Int. Cl.[4] ..... F23Q 9/14

[52] U.S. Cl. ..... 137/78.1; 251/117; 251/129.02; 431/18; 431/60

[58] Field of Search ..... 431/18, 60; 137/599, 137/599.1, 78.1; 251/117, 129.02

[56] References Cited

U.S. PATENT DOCUMENTS

| | | | |
|---|---|---|---|
| 1,978,737 | 10/1934 | Bower et al. | 137/599 X |
| 2,295,611 | 9/1942 | Smith | 137/599 X |
| 2,304,641 | 12/1942 | Jones | 431/60 |
| 2,621,051 | 12/1952 | Kramer | 137/599 |
| 3,188,836 | 6/1965 | Kniebes | 431/60 X |
| 3,330,133 | 7/1967 | Kniebes | 431/60 |
| 3,632,283 | 1/1972 | Kniebes | 431/60 |
| 3,829,060 | 8/1974 | von Lewis | 251/129.02 |

FOREIGN PATENT DOCUMENTS

| | | | |
|---|---|---|---|
| 2125002 | 4/1972 | Fed. Rep. of Germany | 137/599 |
| 167973 | 12/1981 | Japan | 137/599 |
| 217877 | 12/1983 | Japan | 137/599.1 |

*Primary Examiner*—Stephen M. Hepperle
*Attorney, Agent, or Firm*—Paul M. Denk

[57] ABSTRACT

A self-contained gas light control module is disclosed as including a tubular housing with a main tubular gas line extending through the housing and a normally open electro-mechanical valve in the gas line to permit flow of gas therethrough at night. During day light hours, a solar cell is activated to close the normally open electro-mechanical valve and shut-off the main tubular gas line; however, a smaller by-pass gas passageway or line is connected around the electro-mechanical valve to permit a smaller amount of continuous gas flow around the electro-mechanical valve, when closed, for low pilot flame burning of the gas light during day light hours.

6 Claims, 3 Drawing Sheets

SOLAR ACTIVATED GAS LIGHT CONTROL MODULE

BACKGROUND OF THE INVENTION

The present invention relates to gas light controls, and more particularly, to a solar activated self-contained gas light control module.

Decorative gas lanterns or gas lights dot the landscapes across America, particularly in and around homes. These gas lanterns or gas lights burn brightly at night to enhance night vision. During the day, sunlight will exceed the light level emitted from the gas lanterns or gas lights, and thus, the use of the same amount of gas during the day as that used at night is neither practical nor desirable.

Recently, gas light controls have been developed which automatically dim a gas lantern or gas light during day light hours, while allowing the gas lantern or gas light to burn brightly during the night. Typically, these gas light controls consist of an automatic control valve with an integral adjustable by-pass section within the valve, and a solar cell activating the automatically control valve to allow the by-pass section to operate during the day. The automatic control valve is "normally open" for evening hours; however, at dawn, electricity generated by a solar cell during day light hours energizes the automatic control valve to a closed position. This substantially reduces the full flow of gas through the main valve channels, but allows the by-pass to provide full "pilot" flame for the mantels within the gas lantern or gas light. At dusk, the solar energy decreases allowing the automatic control valve to open and allow the full flow of gas to the gas lantern or gas lamp. Examples of these previously developed solar activated gas light controls are shown, for example, in U.S. Pat. Nos. 3,188,836; 3,330,133; and 3,632,283.

While these previously developed solar activated gas light controls have operated well, they have had some difficulty in keeping the valve closed, which allows more gas to flow through the gas light controls than is necessary or desired. In addition, they are more complex and much larger than is actually required, resulting in a much costlier product from both an initial manufacture, as well as a replacement standpoint.

SUMMARY OF THE INVENTION

Accordingly, among the several objects and advantages of the present invention include:

the provision of a new and improved self-contained gas light control module for gas lanterns or gas lights;

the provision of the aforementioned self-contained gas light control module which is normally open during the night, but is closed during the day by a solar cell activated control mechanism;

the provision of the aforementioned self-contained gas light control module which includes an automatically controlled main gas line and a continuously open by-pass gas passageway or line;

the provision of the aforementioned self-contained gas light control module wherein the continuously open by-pass gas passageway or line is adjustable by a screw driver or the like that is operated from outside of the module housing;

the provision of the aforementioned self-contained gas light control module, including a normally open solenoid control shut-off valve for engaging and closing a through passageway in an electro-mechanical valve, to close the flow of gas through the main gas line without interrupting the by-pass gas passageway or gas line; and the provision of the aforementioned self-contained gas light control module which is simple to manufacture, install and use; is made of a minimum number of parts; is constructed and designed of smaller and more economical components than other designs; is extremely reliable; allows only the amount of gas necessary and desirable to flow therethrough; is long lasting and durable; and is otherwise well adapted for the purposes intended.

Briefly stated, the self-contained gas light control module of the present invention includes a tubular housing, a main tubular gas line extending through the housing having a gas input and a gas output at opposite ends of the housing and a normally open electro-mechanical valve in the main tubular gas line to permit flow of gas therethrough during night time hours. During day light hours, a solar cell is energized to close the normally-open electro-mechanical valve, and a smaller by-pass gas passageway or line is connected around the electro-mechanical valve to permit a smaller amount of gas to flow for low pilot flame burning of a gas light during the day. The by-pass gas passageway or line has by-pass adjustment means to regulate gas flow through the by-pass gas line. The electro-mechanical valve comprises a solenoid controlled shut-off valve for engaging and closing a through passageway therewithin when operated by the solar cell. The construction and arrangement of the by-pass passageway or line and the electro-mechanical valve, in the overall self-contained gas light control module, affords a simpler, more effective design, as will become apparent.

Other and further objects of the present invention will become apparent from the discussion that is to follow.

BRIEF DESCRIPTION OF THE DRAWINGS

Corresponding reference characters will be used throughout the various Figures of the drawing.

DESCRIPTION OF THE PREFERRED EMBODIMENT

Figure 1:
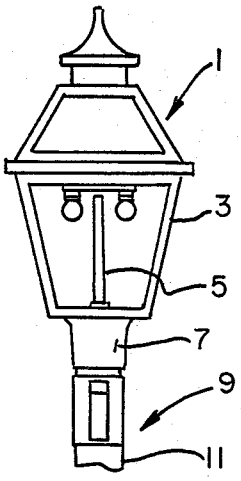
FIG. 1 is a front elevational view of a ga lantern or gas lamp incorporating the self-contained gas light control module of the present invention.

As shown in FIG. 1 of the drawing, the gas lantern or gas light 1 includes a decorative head 3 with glass or plastic windows, as is well known, and a burner assembly 5 including gas mantels which are lit to illuminate the gas lantern or gas light 1. A gas light collar 7 extends below the gas light head 3 for attachment to the self-contained solar activated gas light control module 9 of the present invention. The gas light control module 9 is mounted between the gas light collar 7 and the tubular body or stand 11 that supports the gas light 1 on a ground surface.

Figure 2:
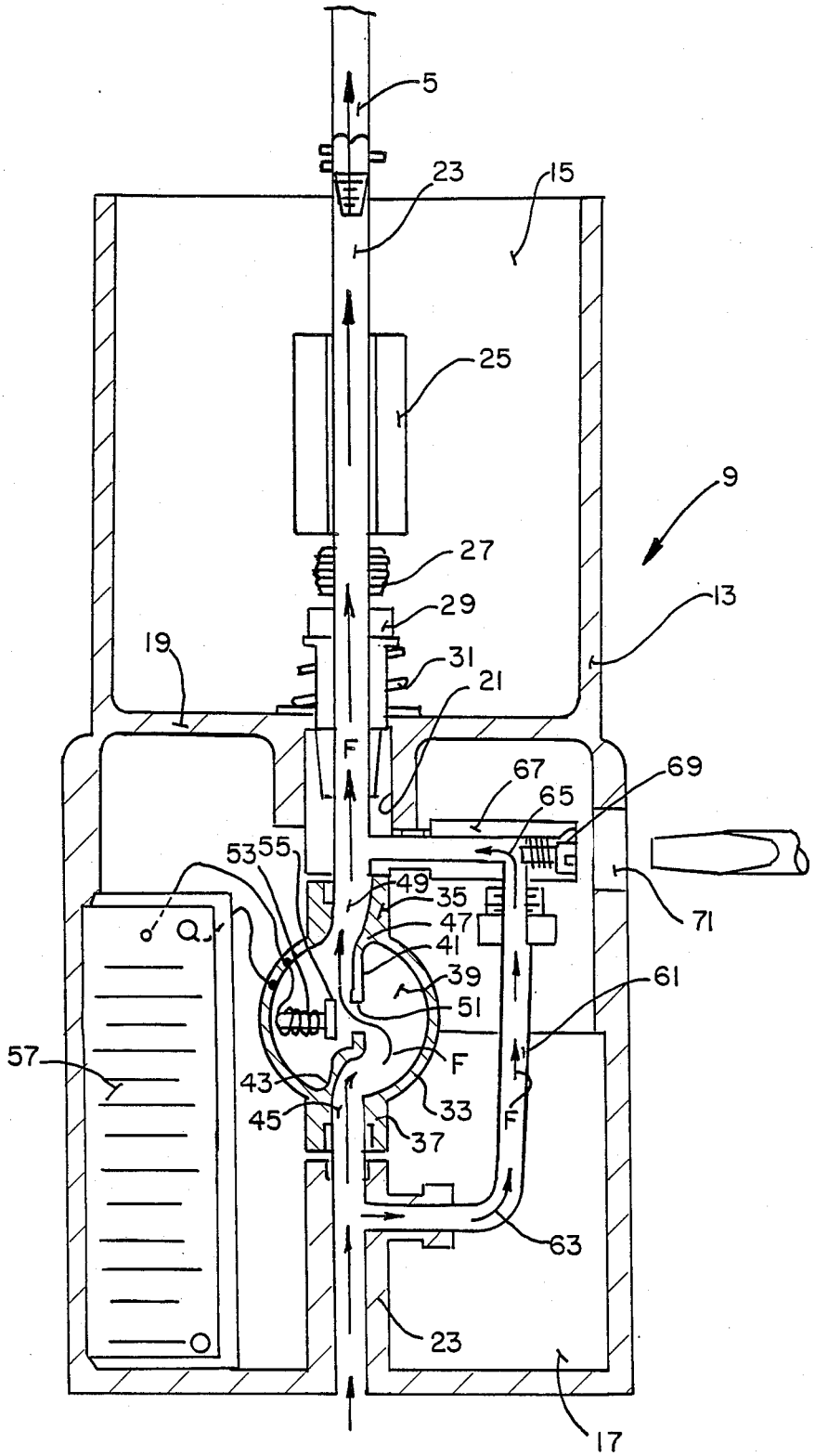
FIG. 2 is a sectional view illustrating the self-contained gas light control module with full gas flow therethrough during evening hours.
Figure 3:
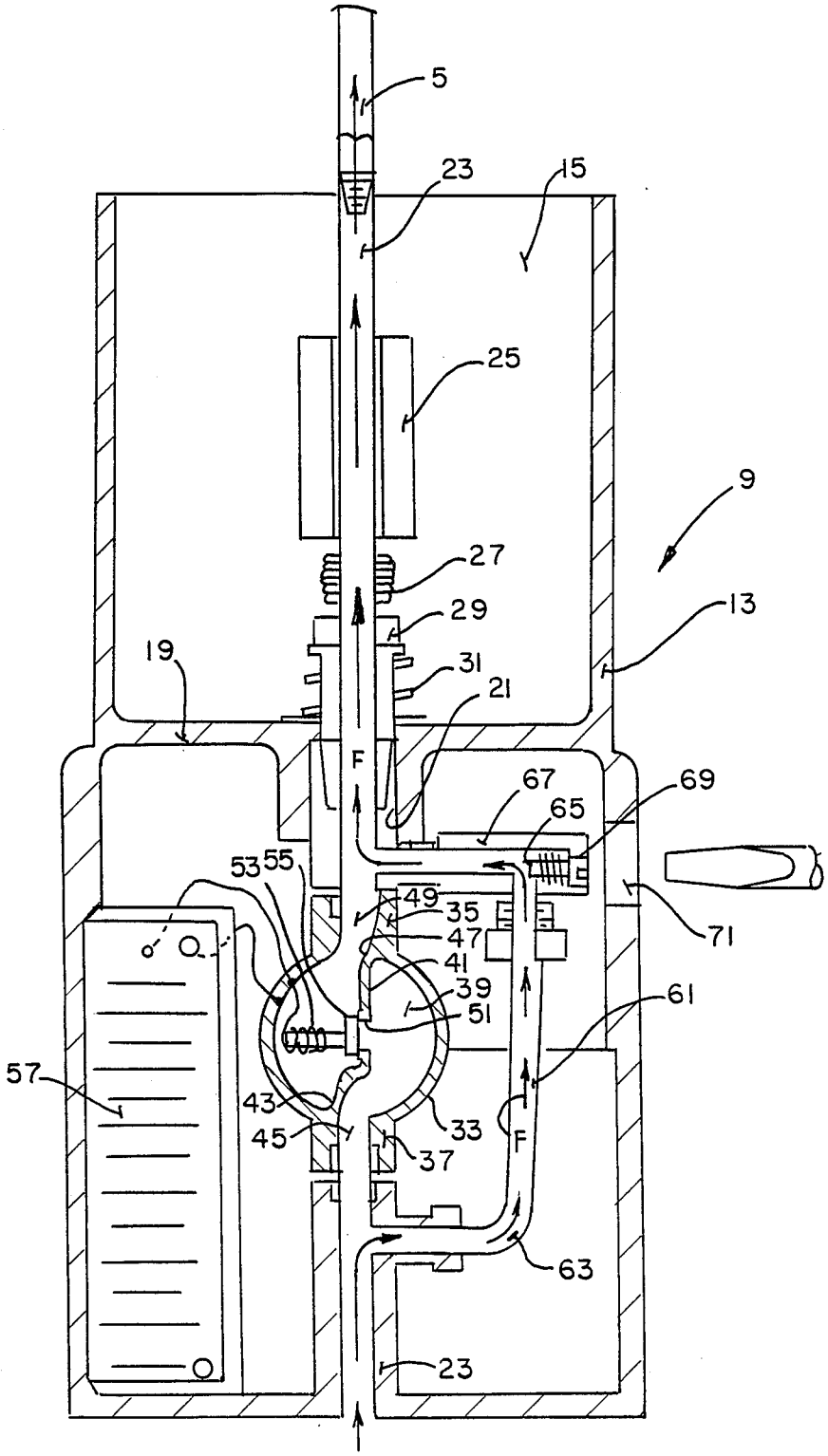
FIG. 3 is a sectional view similar to FIG. 2, but illustrating the solar cell deactivating the normally-closed electro-mechanical valve in the main gas line to allow a smaller amount of gas to flow through the by-pass gas line during day light hours.
Figure 4:
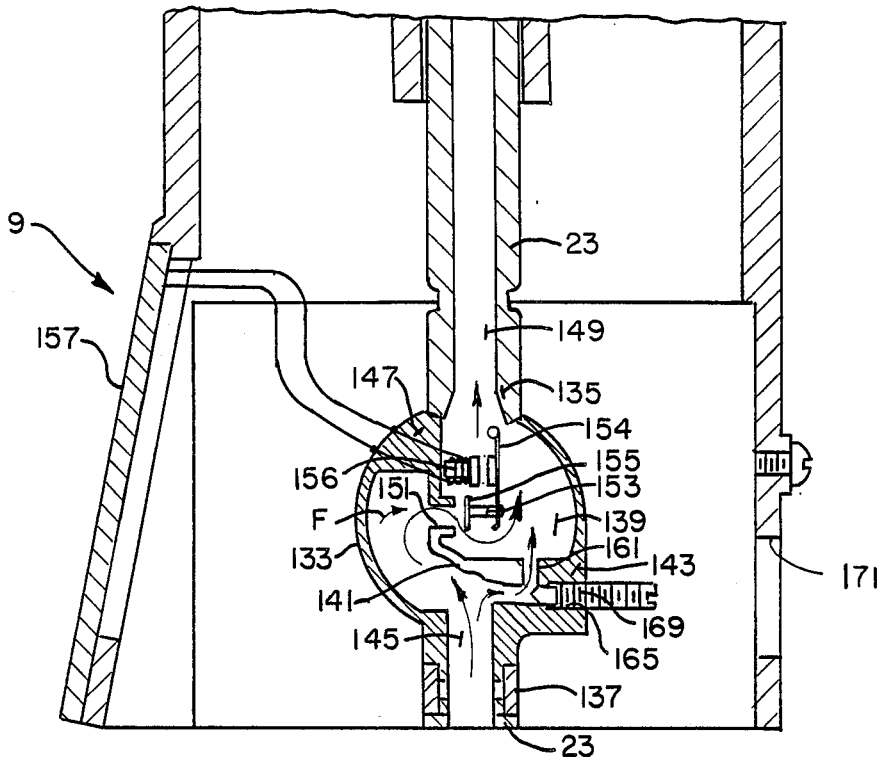
FIG. 4 is a sectional view illustrating a modified form of self-contained gas light control module with full gas flow therethrough during evening hours.
Figure 5:
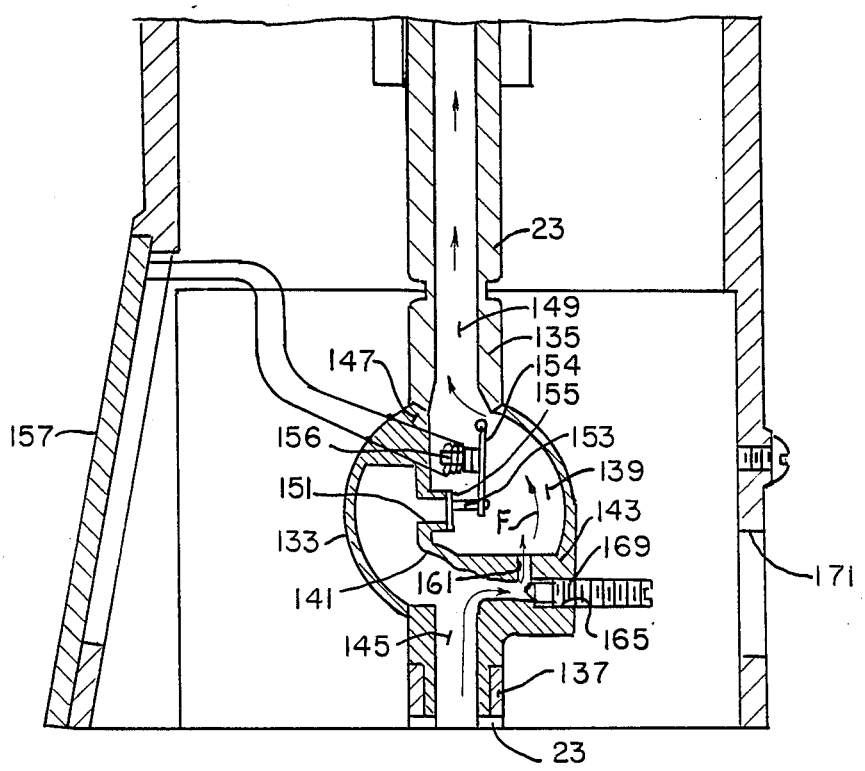
FIG. 5 is a sectional view similar to the FIG. 3 embodiment, but showing gas flowing only through a smaller gas line chamber during daylight hours.

In the description that follows, there are two embodiments, the embodiment of FIGS. 2–3 and the embodiment of FIGS. 4–5.

Reference is first made to FIGS. 2–3 of the drawings for the description of the construction and operation of the self-contained gas light control module 9 of the present invention shown in the FIGS. 2–3 embodiment.

As will be explained in detail below, the self-contained gas light control module 9 automatically dims the gas light 1 during day light hours, but allows it to burn brightly during the night.

The self-contained gas light control module 9 includes a die cast aluminum tubular housing 13 which is constructed and sized in the shape illustrated in the drawings. The tubular housing 13 includes upper and lower chambers 15, 17 separated by an intermediate wall 19 having a through bore or aperture 21 extending between the upper and lower chambers 15, 17 respectively. The main tubular gas line 23 extends through the upper and lower chambers 15, 17 and the through bore 21 of the tubular housing 13, and is secured in place by the adaptor fitting 25 which threadably engages the externally threaded ferrule section 27 of the spring biased tubular fitting 29. The spring biased tubular fitting 29 extends within the through bore 21 and is resiliently biased relative to the intermediate wall 19 by the coil spring 31 which extends therearound. Thus, the adapter fitting 25, through complementary mating engagement with the spring biased tubular fitting 29, may hold the main tubular gas line 23 in a fixed position relative to the tubular housing 13, as illustrated in the drawings. It will of course be understood that a variety of different kinds of adapters and threaded connections may be used to secure the main tubular gas line 23 relative to the tubular housing 13, as may be desired.

The principal components of the self-contained gas light control module are preferably contained within the lower chamber 17 of the tubular housing 9. Specifically, it will be seen that the main tubular gas line 23 includes a normally open electro-mechanical valve 33 that includes upper and lower tubular necks 35, 37 which are interconnected to the main gas line 23, as illustrated. The normally open electro-mechanical valve 33 is preferably constructed as a spherical body, as illustrated, with a spherical chamber 39 therein. A generally longitudinally extending wall 41 extends across the spherical chamber 39 and is connected at 43 to the spherical body 33 on one side of an opening 45 along the lower part of the spherical body 33, while the upper portion of the wall 41 is connected to spherical body 33, on an opposite side of the through opening 45 that extends through the upper tubular neck 35. As will be appreciated, the through bores or openings 45, 49 in the upper and lower tubular necks 35, 37, respectively, are generally aligned with each other and the main tubular gas line 23, while the wall 41 is interconnected to the spherical body 33 at 43 and 47 on opposite sides of the aligned lower and upper through bores or openings 45, 49, as described above and as illustrated in the drawings.

A gas flow opening 51 is formed in the generally longitudinally extending wall 41 of the normally open electro-mechanical valve 33 to permit the flow of gas from the main tubular gas line 23, as represented by the arrows F, through the normally open electro-mechanical valve 33 and the remainder of the self-contained gas light control module 9 for flow of gas to the gas burner assembly 5. During evening hours when the gas lamp 1 is desired to be lit to its maximum desired output, the flow of gas through the main tubular gas line 23 will not be interrupted by the normally open electro-mechanical valve 33.

However, during day light hours, the normally open electro-mechanical valve is constructed to close the gas flow opening or passageway 51 in the wall 41 to shut off the flow of gas through the normally open electro-mechanical valve 33. For this purpose, a solenoid controlled shut-off plunger 53 is employed having an enlarged head 55 which closes or shuts off the gas flow passageway or opening 51 in the wall 41. The solenoid controlled shut off plunger 53 is electrically connected, as illustrated, to the solar cell 57 which has an outer exposed face for exposure to sunlight. Electricity generated by the solar cell 57 during daylight hours energizes the solenoid controlled plunger 53 to close the gas flow passageway or opening 51 in the normally open electro-mechanical valve 33.

In conjunction with the normally open electro-mechanical valve 33, a smaller tubular by-pass gas line 61 extends around the normally open electro-mechanical valve 33 and includes two approximately 90° bends 63, 65 therein, as will be appreciated. Gas continuously flows in the smaller tubular by-pass gas line 61, even when the normally open electro-mechanical valve 33 is closed during day light hours, as described above. The smaller tubular by-pass gas line 61 may interconnected and supported to the main tubular gas line 23 in any way desired, to afford the by-pass connection around the normally-open electro-mechanical valve 33.

The by-pass gas line 61 includes a by-pass adjustment means in the form of a collar 67 that is releasably mounted on the upper 90° bend 65 and having a set screw 69 cooperating therewith for entering within the through passageway of the by-pass gas line 61, as illustrated, to regulate the amount of gas flow through the smaller by-pass gas line 61. It will be noted that the collar 67 is mounted on the upper 90° bend 65 so as to extend in a direction generally transverse to the tubular housing 9. This permits the head of the set screw 69 to register with a tool opening 71 in the tubular housing 9, for adjustment of the set screw 69 relative to the through passageway of the by-pass gas line 61, to regulate the amount of gas flow therethrough.

In operation, the self-contained gas light control module 9 automatically dims the gas light 1 during daylight hours, but will allow the gas light to burn brightly at night. As shown in FIG. 2 of the drawings, the night time conditions illustrate the normally open electro-mechanical valve 33 in an opened condition to allow gas flow F through the main tubular gas line 21, including through the normally open electro-mechanical valve 33, as well as through the smaller tubular by-pass gas line 61. During day light hours, electricity generated by the solar cell 57 activates the solenoid controlled shut-off plunger 53 to cause the enlarged head 55 thereof to close the gas flow passageway 51 in the wall 41 of the normally open electro-mechanical valve 33. This closes off the flow of gas F through the normally open electro-mechanical valve 33 because it is now in a closed position. However, since gas flow F continuously flows through the smaller tubular by-pass gas line 61, a sufficient amount of gas will flow to the burner assembly 5 to permit low pilot flame burning of the gas light during the day. The amount of gas flowing through the smaller tubular by-pass gas line 61 may be regulated by adjusting the set screw 69 to close off the opening of through passageway within the smaller tubular by-pass gas line 61, as will be understood.

The main tubular gas line 23 may be designed to operate at about 3 thousand BTU's or 3 cubic feet of gas per hour flow therethrough, whereas the smaller tubular by-pass gas line 61 may operate at a gas capacity of about 750 BTU's, allowing 0.75 cubic feet per hour of gas flow therethrough. The photo or solar cell 57 is large enough to generate about 50 milliamps and 2.4 volts whereas the solenoid controlled or activated plunger 53 is designed to operate at 35 milliamps and 1.5 volts. Increased photovoltaic or solar cell capacity is desired, in conjunction with the overall construction and operation of the self-contained gas light control module 9 of the present invention, to insure a closing of the electro-mechanical valve 33, without any gas F flowing therethrough.

Reference is now made to the embodiment shown in FIGS. 4–5 of the drawings in which the self-contained gas light module 9 is similar to the FIGS. 2–3 embodiment, with the exception of the construction and operation of the electro-mechanical valve 133. The normally open electro-mechanical valve 133 includes upper and lower tubular necks 135, 137 which are interconnected to the main gas line 23 that extends on opposite sides of the electro-mechanical valve 133. It will be noted that the normally open electro-mechanical valve 133 is also preferably constructed as a spherical body with a spherical chamber 139 therein. A specially constructed wall 141 extends across the spherical chamber 139 and is connected on opposite sides of the upper and lower tubular necks 135, 137. Specifically, the lower tubular neck 137 includes an integral upwardly extending and offset portion 143 which is connected to the wall 141, at the right side of the tubular neck 137, while the wall 141 is connected at 147 adjacent the upper tubular neck 135.

As shown in FIGS. 4–5 of the drawings, the upper tubular neck 135 has a through bore 149 which is generally aligned with the through bore 145 in the lower tubular neck 137, on opposite sides of the electro-mechanical valve 133, facilitating connection of the main tubular gas line 23 on opposite sides thereof and in general alignment with one other.

A gas flow opening 151 is formed in the wall 141 of the normally open electro-mechanical valve 133 to permit the flow of gas from the main tubular gas line 23, as represented by the arrows F, through the normally open electro-mechanical valve 133, and then upwardly through the main tubular gas line 23 for flow through the remainder of the self-contained gas light control module 9 and flow of gas to the gas burner assembly 5 of the gas light 1.

During evening hours when the gas light 1 is desired to be lit to its maximum desired output, the flow of gas through the main tubular gas line 23 will flow uninterruptedly through the normally open electro-mechanical valve 33, including through the gas flow opening 151 in the wall 141. However, during daylight hours, the normally open electro-mechanical valve 133 is operated to close the gas flow opening 151 in the wall 141 to shut off the flow of gas through the normally open electro-mechanical valve 133. This is accomplished by utilizing a solenoid controlled shut-off plunger 153 having an enlarged head 155 which closes or shuts off the gas flow opening 151 in the wall 141. It will be noted that the solenoid controlled shut-off plunger 153 is connected to a lever arm 154 having magnetic contacts that are moved into contact with the electro-magnet 156, within the electro-mechanical valve 133. The electro-magnet 156 is mounted at 147 to the spherical body of the electro-mechanical valve 133. The electro-magnet or solenoid 156 is operated by a solar cell 157 which has an outer exposed face for exposure to sunlight. Electricity generated by the solar cell 157 during daylight hours energizes the electro-magnet or solenoid control plunger 153 to close the gas flow passageway 151 in the normally open electro-mechanical valve 133.

As distinct from the FIGS. 2–3 embodiment, in lieu of employing a smaller tubular by-pass gas line 61 around the normally open electro-mechanical valve 133 as shown in FIGS. 2–3, the FIGS. 4–5 embodiment provides a continuously open passageway 161, in an area between wall 141 and the upstanding and offset section 143, permitting gas to continuously flow from the main tubular gas line 23 through the smaller by-pass gas passageway 161, even when the normally open electro-mechanical valve 133 is closed during daylight hours, as shown in FIG. 5 of the drawings.

The by-pass gas passageway 161 includes a by-pass adjustment means in the form of a set screw 169 that is received within a threaded opening 165 that intersects with the by-pass gas passageway 161, thereby enabling set screw 169 to regulate the amount of gas flow through the smaller by-pass gas passageway 161, as may be desired. A tool opening 171 in the tubular housing 9 enables adjustment of the set screw 169 relative to the smaller by-pass gas passageway 161, permitting adjustment and regulation of gas flowing therethrough.

The operation of the FIGS. 4–5 embodiment is similar to FIGS. 2–3. Specifically, the self contained gas light control module automatically dims the gas light during daylight hours, but allows the gas light 1 to burn brightly at night. FIG. 4 of the drawings shows the night time conditions in which the normally open electro-mechanical valve 133 is in an open condition enabling gas flow as represented by the arrows F, to flow through both the opening 151 in the wall 141, as well as through the smaller gas passageway 161. However, during daylight hours, electricity generated by the solar cell 157 activates the solenoid controlled shut off plunger 153 causing the enlarged head 155 thereof to close the gas flow passageway 151 in the wall 141 of the normally open electro-mechanical valve 133. As a result, only a small amount of gas will flow through the smaller gas passageway 161, as illustrated in FIG. 5 of the drawings, because the electro-mechanical valve 133 is now in a closed position. The amount of gas flowing through the smaller tubular by-pass gas passageway 161 may be regulated by simply adjusting the set screw 169 to open or close the opening of the by-pass gas passageway 161, as will be readily understood.

From the foregoing, it will be appreciated that the present invention discloses a new and improved self-contained gas light control module for gas lanterns or gas lights. During night time hours, the flow of gas through the system is sufficient to generate the amount of illumination desired. During day time hours, a solar activated solenoid controlled plunger operates to close a normally open electro-mechanical valve to shut off the flow of gas through the normal main gas line, while still permitting gas flow through a smaller by-pass gas passageway or line to maintain low pilot flame burning of the gas light during the day.

In view of the above, it will be seen that the several objects of the invention are achieved and other advantageous results are obtained.

As various changes could be made in the above construction without departing from the scope of the invention, it is intended that all matter contained in the above description or shown in the accompanying drawings shall be interpreted as illustrative and not in a limiting sense.

What is claimed:

1. A self-contained gas light control module comprising: a tubular housing; a main tubular gas line extending through said housing having a gas input and a gas output at opposite ends of said housing; a normally opened electro-mechanical valve in said gas line to permit flow of gas therethrough, a solar cell connected to said electro-mechanical valve to close said valve during daylight hours; a smaller by-pass gas passageway connected to said main tubular gas line around said electro-mechanical valve to permit a smaller amount of continuous gas flow to flow to said gas light, for low pilot flame burning of said gas light during the day, said smaller by-pass gas passageway including a smaller tubular independent by-pass gas line connected to said main tubular gas line around said electro-mechanical valve, a by-pass adjustment means to regulate the amount of gas flow through said smaller by-pass gas line, said smaller by-pass gas line including two approximately 90° bends therein and said by-pass adjustment means including a collar releasably mounted on one of said approximately 90° bends and having a set screw extending into the interior of said smaller by-pass gas line for regulating the amount of gas flowing therethrough.

2. The self-contained gaslight control as defined in claim 1 wherein said collar is mounted on said approximately 90° bend in a direction generally transverse to said tubular housing, said set screw being threadably mounted to said collar for threadable adjustment along said collar, and said housing having an opening therein for exposing said set screw to permit adjustment thereof.

3. The self-contained gas light control module as defined in claim 2 wherein said normally open electro-mechanical valve comprises a solenoid controlled shut-off valve for engaging and closing a through passageway when operated by said solar cell.

4. The self-contained gas light control module as defined in claim 3 wherein said electro-mechanical valve includes a spherical body having upper and lower tubular necks for interconnection with said main tubular gas line, an internal chamber within said spherical body, and a wall extending across said chamber and having an opening therein for normal open flow of gas therethrough until engaged by said solenoid control shut-off valve.

5. The self-contained gas light control module as defined in claim 4 wherein said wall within said spherical body extends generally along the same direction as said main tubular gas line, and said solenoid control shut-off valve extends and operates generally transverse to said wall for closing the opening therein, when activated.

6. The self-contained gas light control module as defined in claim 4 wherein said solar cell is of such size an capacity to generate approximately 50 milliamps at approximately 2.4 volts.

* * * * *